US006290662B1

(12) United States Patent
Morris et al.

(10) Patent No.: US 6,290,662 B1
(45) Date of Patent: Sep. 18, 2001

(54) PORTABLE, SELF-CONTAINED APPARATUS FOR DEEP VEIN THROMBOSIS (DVT) PROPHYLAXIS

(75) Inventors: John K. Morris, 3125 Hunting Valley, Ann Arbor, MI (US) 48106; Harry E. Colestock, Ann Arbor, MI (US)

(73) Assignee: John K. Morris, Ann Arbor, MI (US)

( * ) Notice: Subject to any disclaimer, the term of this patent is extended or adjusted under 35 U.S.C. 154(b) by 0 days.

(21) Appl. No.: 09/412,819

(22) Filed: Oct. 5, 1999

Related U.S. Application Data

(60) Provisional application No. 60/136,549, filed on May 28, 1999.

(51) Int. Cl.[7] ..... A61H 15/00

(52) U.S. Cl. ..... 601/149; 601/152

(58) Field of Search ..... 101/148–152, 101/11–14, 84, 6; 128/DIG. 20

(56) References Cited

U.S. PATENT DOCUMENTS

| | | | | |
|---|---|---|---|---|
| 2,569,795 | * | 10/1951 | Avery . | |
| 3,892,229 | | 7/1975 | Taylor et al. . | |
| 3,901,221 | * | 8/1975 | Nicholson et al. . | |
| 3,908,642 | * | 9/1975 | Vinmont . | |
| 3,971,398 | | 7/1976 | Taylor et al. | 137/119 |
| 4,013,069 | * | 3/1977 | Hasty | 601/152 |
| 4,153,050 | * | 5/1979 | Bishop et al. | 601/152 |
| 4,215,679 | * | 8/1980 | Rustin | 601/34 |
| 4,280,489 | * | 7/1981 | Johnson, Jr. | 602/27 |
| 4,453,538 | * | 6/1984 | Whitney | 601/152 |
| 4,624,244 | * | 11/1986 | Taheri | 601/152 |
| 4,702,232 | | 10/1987 | Gardner et al. . | |
| 4,702,235 | * | 10/1987 | Hong . | |
| 4,722,332 | | 2/1988 | Saggers . | |
| 4,841,956 | | 6/1989 | Gardner et al. . | |
| 4,941,458 | * | 7/1990 | Taheri | 601/152 |
| 5,014,681 | | 5/1991 | Neeman et al. . | |
| 5,263,473 | | 11/1993 | McWhorter . | |
| 5,354,260 | * | 10/1994 | Cook | 602/13 |
| 5,413,142 | * | 5/1995 | Johnson et al. | 137/515.5 |
| 5,441,533 | * | 8/1995 | Johnson et al. | 607/104 |
| 5,496,262 | * | 3/1996 | Johnson | 601/152 |
| 5,503,618 | * | 4/1996 | Rey | 601/15 |
| 5,536,233 | * | 7/1996 | Khouri . | |
| 5,558,627 | * | 9/1996 | Singer et al. | 602/13 |
| 5,571,075 | | 11/1996 | Bullard | 601/152 |
| 5,584,798 | * | 12/1996 | Fox | 601/152 |
| 5,634,889 | | 6/1997 | Gardner et al. | 601/151 |
| 5,669,872 | | 9/1997 | Fox | 601/152 |
| 5,674,262 | | 10/1997 | Tumey | 607/48 |
| 5,711,760 | | 1/1998 | Ibrahim et al. | 601/149 |
| 5,747,460 | * | 5/1998 | Bylund et al. | 514/19 |
| 5,783,563 | | 7/1998 | Antonsson et al. | 514/19 |
| 5,826,761 | | 10/1998 | Basaj | 223/112 |
| 5,833,711 | * | 11/1998 | Schneider, Sr. | 607/3 |
| 5,876,359 | * | 3/1999 | Bock et al. | 601/150 |

FOREIGN PATENT DOCUMENTS

6197934 * 7/1994 (JP) .

* cited by examiner

*Primary Examiner*—Danton D. DeMille
(74) *Attorney, Agent, or Firm*—Gifford, Krass, Groh, Sprinkle, Anderson & Citkowski, PC

(57) ABSTRACT

An entirely self-contained, patient-worn apparatus for deep vein thrombosis (DVT) prophylaxis, and other conditions includes an inflatable/deflatable bladder disposed against an extremity such as the upper calf, foot, or hand of a patient, or within a cast. An inelastic member is preferably used to fully enclose the bladder and body part, such that compressive forces are directed substantially entirely against the body part of the patient when the bladder expands, thereby conserving the power and reducing the volume of pneumatic compression required to operate the device. Given this conservation of energy, the invention may be battery operated from a source immediately proximate to the bladder arrangement, enabling the entire device to be self-contained and, in fact, worn by the patient. The reduced volume also allows the use of miniaturized components including the compressor motor and compressor.

18 Claims, 7 Drawing Sheets

PORTABLE, SELF-CONTAINED APPARATUS FOR DEEP VEIN THROMBOSIS (DVT) PROPHYLAXIS

REFERENCE TO RELATED APPLICATIONS

This application claims priority from U.S. provisional patent application Ser. No. 60/136,549, filed May 28, 1999, the entire contents of which are incorporated herein by reference.

FIELD OF THE INVENTION

This invention relates generally to body massaging appliances and, more particularly, to a portable, self-contained apparatus for deep vein thrombosis prophylaxis.

BACKGROUND OF THE INVENTION

Persons undergoing surgery, anesthesia and extended periods of bed rest or other inactivity are often susceptible to a condition known as deep vein thrombosis, or DVT, which is a clotting of venous blood in the lower extremities and/or pelvis. This clotting occurs due to the absence of muscular activity in the lower extremities required to pump the venous blood (stasis), local vascular injury or a hypercoaguble state. The condition can be life-threatening if a blood clot migrates to the lung, resulting in a "pulmonary embolus" or otherwise interferes with cardiovascular circulation.

It is known that this condition may be controlled or alleviated by applying intermittent pressure to a patient's legs to assist in blood circulation (venous return). Many devices have been proposed, including compression boots and other inflation tube devices, but heretofore all of the proposed solutions have been complex, or bulky, or both, and in each case, certainly not portable and self-contained.

One reason why currently available devices are large and complex is due to the fact that the precise level of pulsatile activity required to manage the condition is largely unknown. Commercial devices may therefore provide a more complex massaging action than is necessary. As a result, many existing devices include a plurality of inflatable chambers, spaced at intervals along the leg of a patient, with complex sequencing means being used to provide a vertical pumping action to direct blood flow through the leg and into the torso. Apart from the fact that such sophistication may be unnecessary in many cases, the use of a complex sequential pumping operation requires the use of a heavy and expensive drive unit, precluding portability. Devices of this type are described in U.S. Pat. Nos. 4,013,069; 4,453,538; 4,702,232; 4,841,956; 4,941,458; 5,014,681; 5,263,473; and 5,674,262, and elsewhere.

Although less complex inflation devices have been disclosed, the descriptions rely upon conventional non-portable compressed-air sources. A case in point is U.S. Pat. No. 4,153,050, which describes a DVT stocking used in conjunction with a fillable bladder having only a few chambers. The result is a less complex structure, however, even in this case, the bladders are interconnected to a remote air supply through an interconnecting conduit. No mention is made of true device self-containment and portability.

The need therefore remains, for a portable, self-contained, preferably wearable, device to prevent DVT and like venous conditions. Such a device would also improve upon current devices which, being cumbersome in nature, lead to poor compliance on the part of the user, and are accordingly less effective. Additionally, existing devices, which must be tethered to pneumatic control units, are difficult to apply to the same extremity associated with a particular surgical procedure. For example, it is difficult to apply existing devices to the leg associated with same side hip surgery due to the required interconnections.

SUMMARY OF THE INVENTION

The subject invention improves upon the prior-art by providing an entirely self-contained, patient-worn apparatus for deep vein thrombosis (DVT) prophylaxis, and related conditions. According to a preferred embodiment, an inflatable/deflatable bladder is disposed against an extremity such as the upper calf, foot or within a cast. To treat edema, an inflatable/deflatable bladder may be disposed against at least a portion of the hand. A generally inelastic member is preferably used to fully enclose the bladder and associated body part, such that compressive forces are directed substantially entirely against the body part of the patient when the bladder expands, thereby conserving the power and reducing the volume of pneumatic compression required to operate the device. Given this conservation of energy, the invention may be battery operated from a source immediately proximate to the bladder arrangement, enabling the entire device to be self-contained and, in fact, worn by the patient. The reduced volume also allows the use of miniaturized components including the compressor motor and compressor.

The miniature pump is preferably capable of inflating the bladder to a desired level of pressure so as to augment venous return. A valve may be provided as a pressure release mechanism or, preferably, a natural bleeding of the system is relied upon for decompression following an inflation cycle. The electronics used to drive the compressor, which may be of the type used in commercial blood-pressure measurement cuffs, may be very simple, including a solid-state timer coupled to a relay or other appropriate switching means.

A distinct advantage of the invention is that the device may be worn at all times, including the limb being operated upon during surgery. In an alternative embodiment, to further increase battery life, a sensor may be provided to detect movement of the limb (from which muscle contractions may be implied), such that, should the patient be walking or otherwise active, the pumping action is terminated. One or more mercury switches or other appropriate movement sensors may be utilized for such purpose.

The inventive apparatus may additionally be programmed to decrease the rate of inflation/deflation as a function of time, since it is known that the patient is most vulnerable during and immediately after surgery. Thus, the inventive apparatus may automatically be programmed to facilitate a relatively high inflation/deflation rate during a surgical procedure, but then taper off to a more infrequent cycling as a function of time.

DETAILED DESCRIPTION OF THE INVENTION

Figure 1:
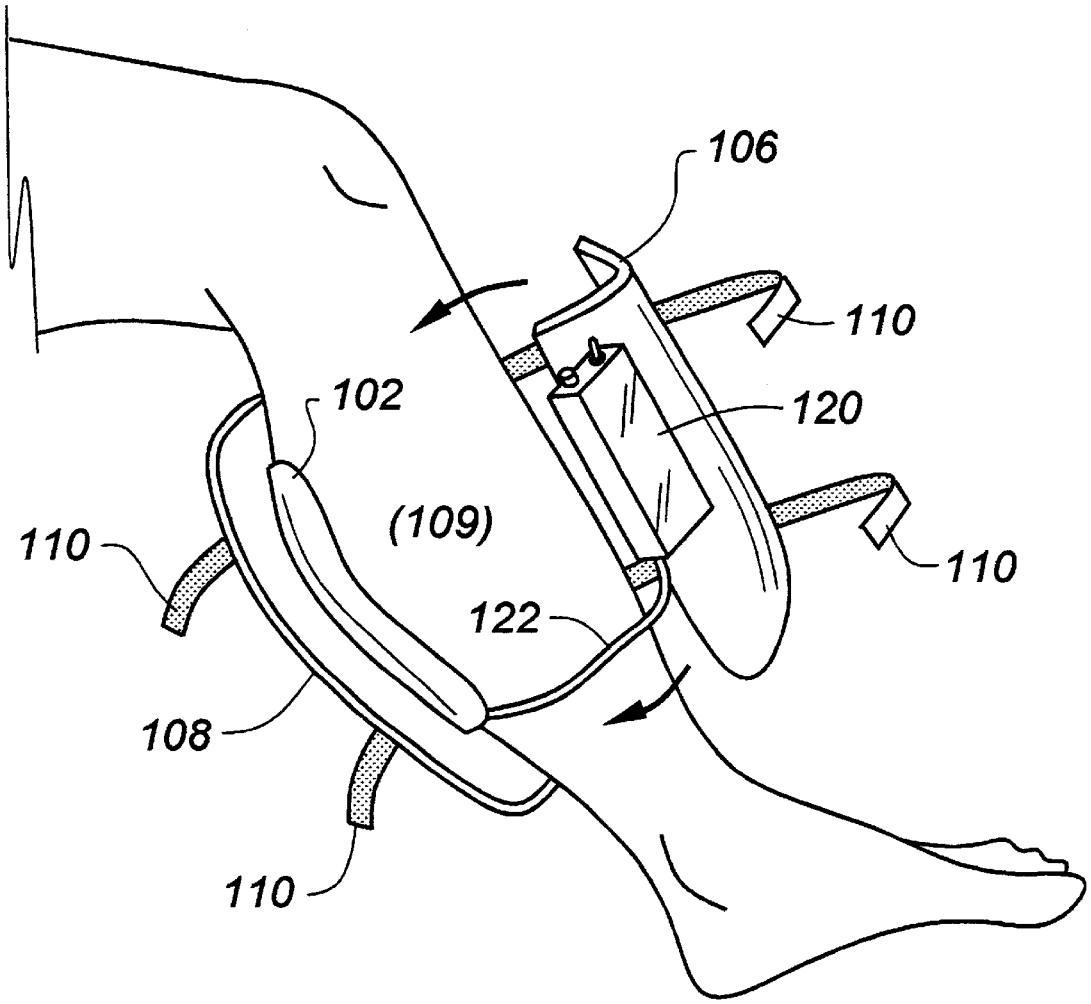
FIG. 1 is a drawing which illustrates an embodiment of the invention including a substantially rigid outer shell operative to direct compressive forces into the upper calf region.

Now making reference to the drawings, FIG. 1 illustrates a preferred assembly according to the invention for placement relative to the upper calf of a human wearer. Upon reading this specification, it will be apparent to one of skill in the art that the depicted structure may be applied to other areas of the body through appropriate physical modification.

In the preferred embodiment, a simple, single-chambered bladder 102 is disposed between a substantially inelastic outer shell and a compressible portion of the extremity, as against the calf muscle 109, as shown. In the depicted embodiment the inelastic outer shell is composed of rigid anterior and posterior shell components 106 and 108, respectively, which are held in position using hook-and-loop straps 110. As an alternative to one or more rigid components, an inelastic fabric may alternatively be employed as the shell material.

In any case, in the preferred embodiment the outer shell circumferentially encases the entire extremity, so that a minimum degree of bladder inflation achieves a desired level of compression, thereby conserving battery power. The bladder interconnects to a pressurization unit 120 through an air path 122. The pressurization unit 120 is preferably mounted with respect to an outer surface of the inelastic shell, resulting in an appliance which is entirely self-contained and portable.

Figure 2:
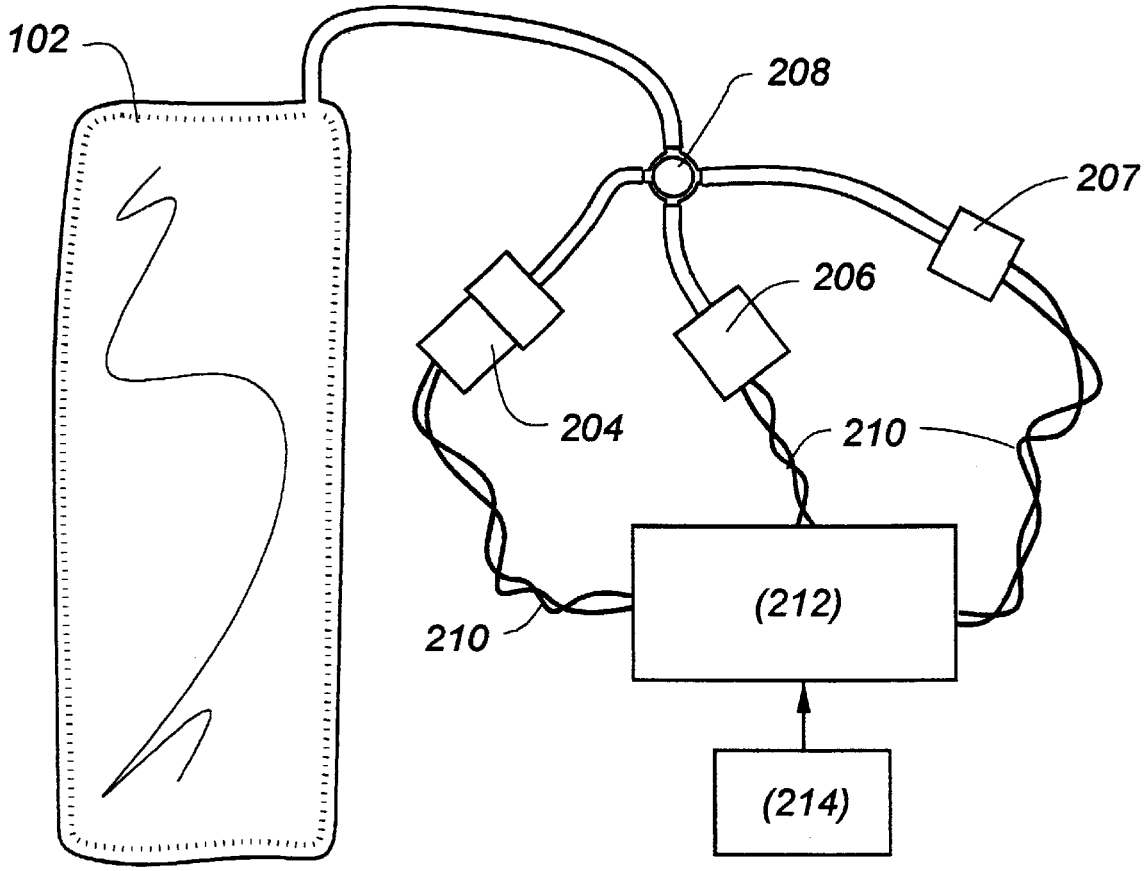
FIG. 2 is a drawing which illustrates major components associated with operating a device according to the invention.

Components which make up the electrical and pneumatic circuitry of the invention are depicted in FIG. 2. These components include the bladder 102 and an electric motor/compressor 204, which can be a very small device. The system further includes a pressure sensor 206, and an optional pressure relief valve 207 which may be used with, or in place of, a passively controlled leak. A coupling 208 places the bladder, compressor and pressure sensor/switch in pneumatic communication with one another. Electrical wiring 210 interfaces to electronic circuitry best seen in FIG. 3. Two user controls 214 are preferably provided, one being an ON/OFF switch and the other being a knob to control frequency of inflation.

Figure 3:
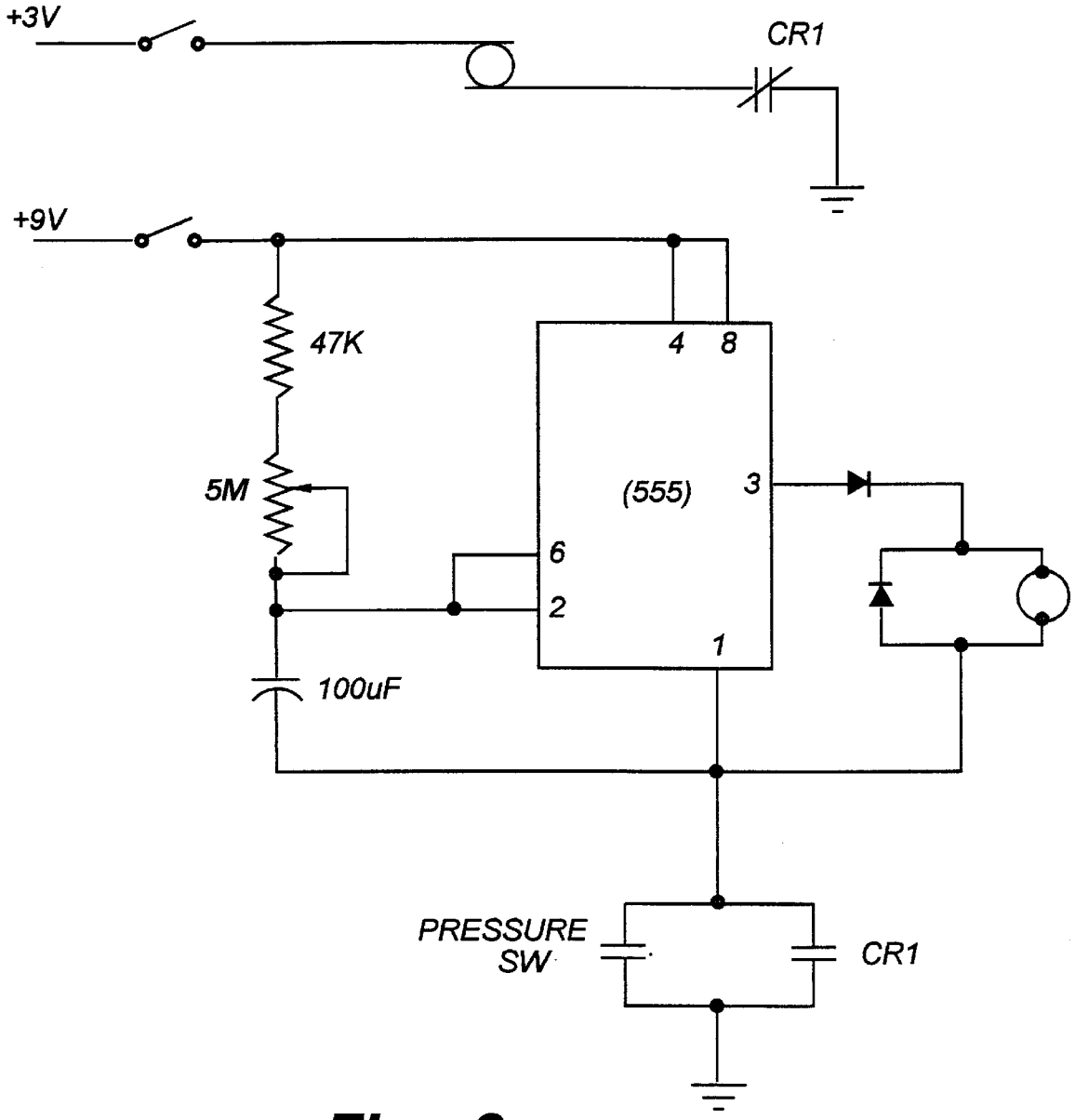
FIG. 3 is a schematic diagram which illustrates preferred electrical circuitry associated with operating the device of FIG. 2.

As shown in FIG. 3, a variable delay based on a 555 timer is used to drive a relay CR1. The relay CR1 uses two sets of contacts—one normally opened and another which is normally closed. The normally open set of contacts is in parallel with the pressure switch to minimize chatter, while the other set of contacts is used to turn the compressor on and off. There are two batteries in this configuration. One is a 9-volt battery used to power the electronics, and the other is a 3-volt battery dedicated to the compressor motor.

The circuitry has been adjusted so that the batteries last at least a week. In terms of duty cycle, a 5 -Megohm potentiometer may be used to vary the inflation/deflation rate from once every minute to once every several minutes. Other repetition rates are possible through appropriate modification to the timing components.

In operation, the compressor is activated to inflate the bladder to achieve a pressure sufficient to augment venous return. For example, it has been determined that a pressure on the order of 50 mm/Hg is adequate, though clearly the invention is not limited in this regard, and maximum pressure may be adjustable through appropriate component adjustment or modification. Deflation of the bladder may either be effectuated through a reliance on system leakage, or a controlled leak valve such as item 207 in FIG. 2 may be added for a faster, more precise rate of deflation. The pressure may also be "held" for a pre-determined period of time, as desired, until the onset of deflation.

Figure 4A:
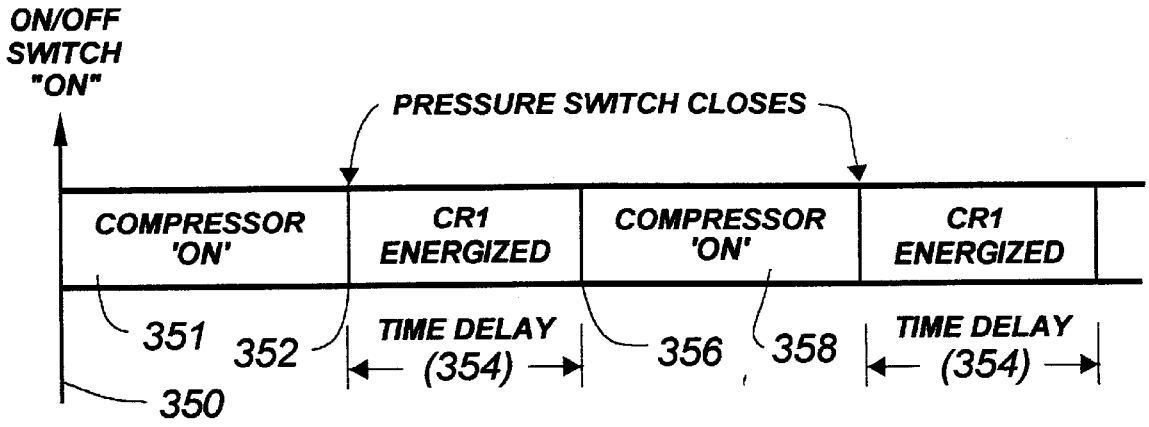
FIG. 4A is a diagram which shows a typical cycling between compression and non-compression according to the invention.

FIG. 4A should help to illustrate the operation of the apparatus according to a preferred method. At time 350, the unit is activated using the ON/OFF switch, with frequency being adjusted using the potentiometer shown in FIG. 3 as discussed above. During time period 351, the compressor is operative to inflate the bladder until the pressure switch detects a desired maximum pressurization, at which point the pressure switch closes at time period 352. This starts a time delay 354 wherein the relay CR1 is energized at the initiation of the delay period. In the event that an active pressure release valve is used, the valve is also energized to release pressure between cycles during the delay period 354.

At the termination of the delay period 354, the time delay relay CR1 drops out at 356, commencing another pressurization cycle with the compressor being energized during period 358, and so on. The cycles continue in this fashion until the ON/OFF switch is turned off.

Figure 4B:
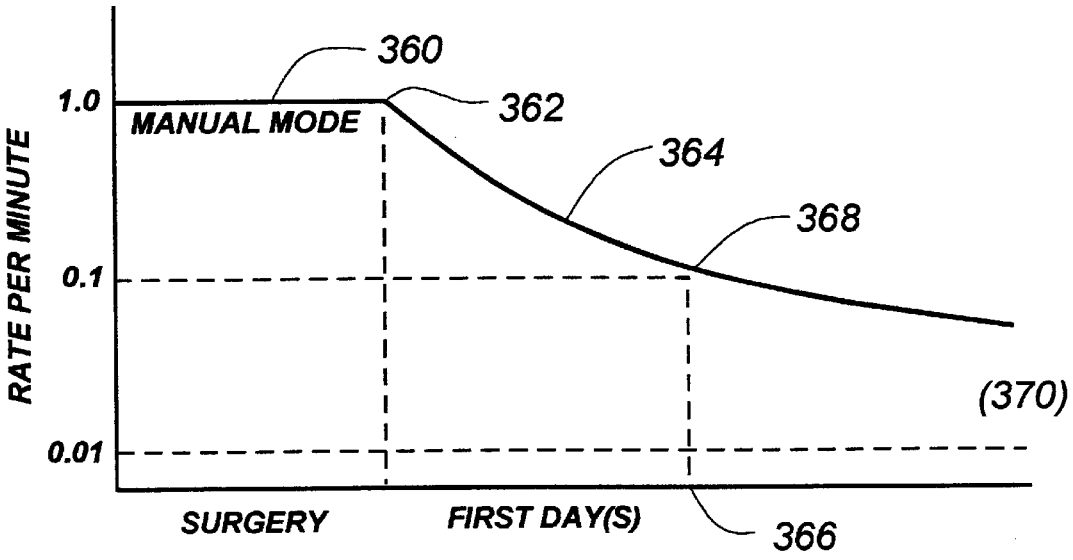
FIG. 4B is a drawing which shows how the frequency of compression/decompression may fall off as a function of time.

With additional electronic sophistication, the level of compression, time delay of decompression, or the cycling between compression and decompression may individually or together be varied as a function of time to facilitate a particular treatment regime, or to save on battery power, or both. As shown in FIG. 4B, for example, the system may operate according to a manual mode during a surgical procedure, for example, wherein the cycling between compression and decompression is relatively high. In the chart of FIG. 4B, a figure of one cycle per minute has been chosen, though such a value is clearly exemplary and may be varied in accordance with component adjustment.

The system may operate during this manual mode during surgery along plateau 360, offering a relatively high cycling rate between compression and decompression. At time 362, a user input (not shown) may be activated to place the system into an automatic mode whereby the cycling rate slowly drops off during the hours and days following surgery, so that in several days' time, the rate may reduce to one cycle every ten minutes at time 366, and even up to one cycle every hour or longer, as the case may be. It will be readily appreciated to one of skill in the art of circuit design, that, in order to accommodate these changes to the operation, the timer shown in FIG. 3 may be replaced with a microcomputer or custom processor, with appropriate software programs and user inputs to carry out the actions just described.

One advantage achieved through portability is that, at least with respect to total hip arthroplasty, the inventive device may be placed on the leg being operated upon. An additional advantage gained through self-contained portability is increased patient compliance. Current devices are cumbersome, often requiring nursing assistance to connect and disconnect tubing running from the compressor unit to the stockings. This results in many "unprotected" periods of time and thus decreased effectiveness. The convenience of this device will not require that it be disconnected to use the bathroom, for example. This is in contrast to existing devices which generally must be placed on the opposite leg until after the procedure. Although this arrangement provides a certain beneficial effect, a greater benefit is gained through positioning on the same extremity as that being operated upon.

To further increase battery life, and to enable a patient to wear the device at all times, in an alternative embodiment, a sensor is provided to detect movement of the limb, such that should the patient be walking or otherwise active, the pumping action is terminated to conserve battery power. A mercury switch or other simple sensor is preferably utilized for such purpose.

Figure 5:
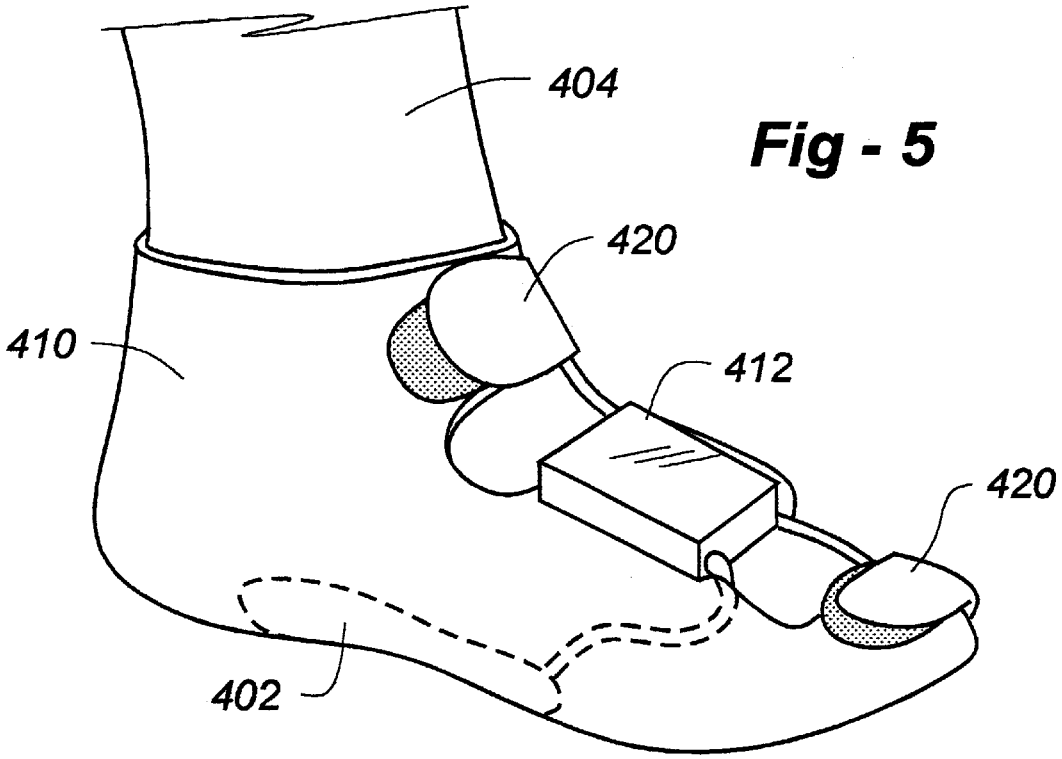
FIG. 5 is a simplified drawing of a foot-worn alternative embodiment of the invention.

The invention is not limited to leg application, and may be applied to any extremity, depending on the condition to be treated or prevented. For example, FIG. 5 illustrates an alternative embodiment of the invention, wherein a bladder 401 is held against the bottom of the foot of a wearer 404 through the use of a shoe-like structure 410. The portable compressor unit 412 may be conveniently located on top of the foot as shown, with a pneumatic line 414 interconnecting the unit 412 to the bladder 402. Velcro straps 420 may be provided to don and remove the appliance. Although the bladder 402 is shown directly under the foot, placement may be altered to the side or even top of the foot, depending on the way the inelastic material comprising the device is precisely arranged.

Figure 6:
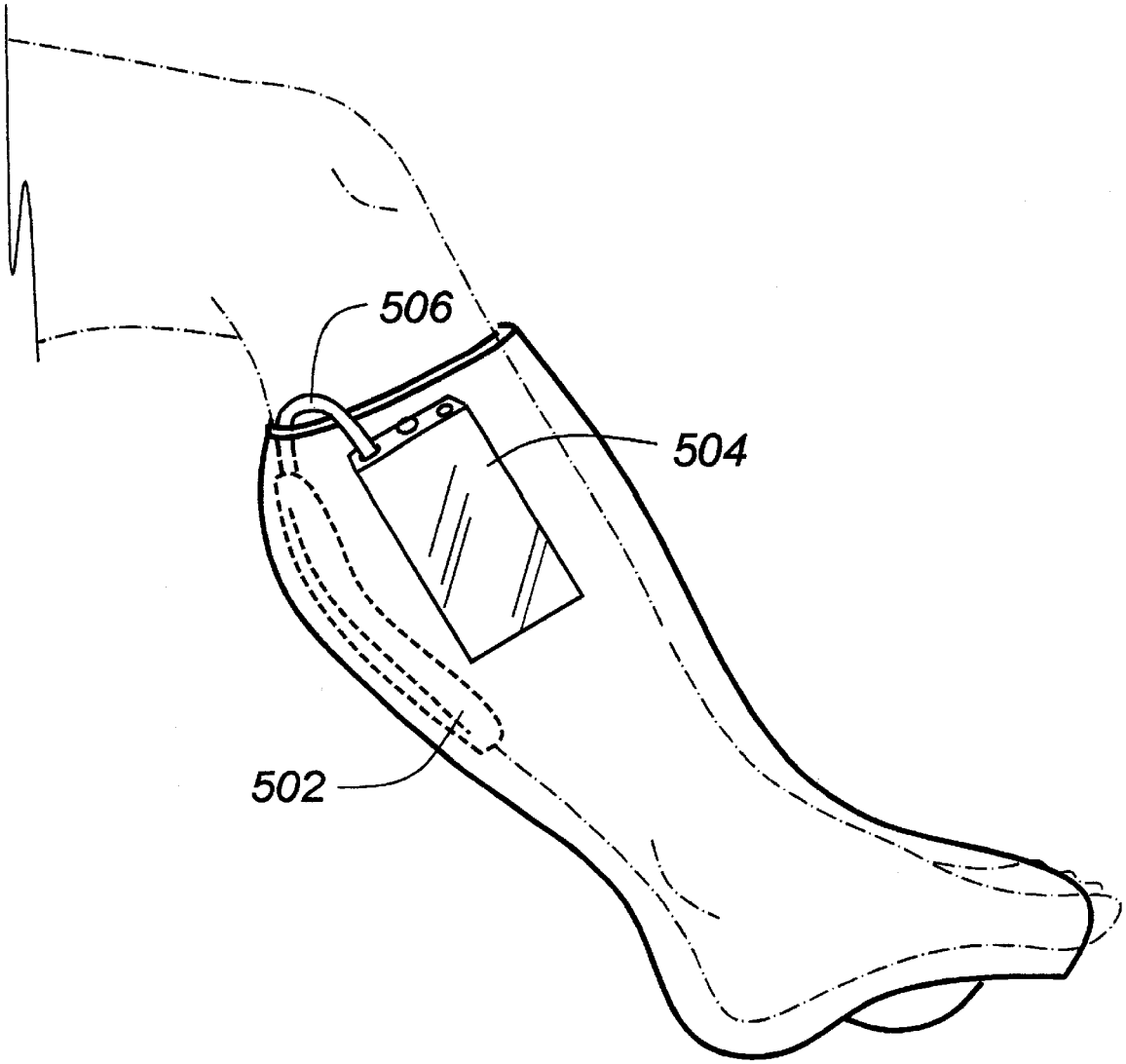
FIG. 6 is a drawing of yet a different alternative of the invention wherein a bladder is introduced in a cast, in this case a leg cast.

The invention is also applicable to existing casts, as shown in FIG. 6. In this case, a bladder 502 interconnected to a portable compressor unit 504 through a short pneumatic tube 506 would be placed against the leg and preferably taped into place. Although the bladder 502 is shown on the back of the leg, it may also be positioned against the side of the calf, on the other side of the leg, or even in front, due to the inventive use of an inelastic outer shell. After this procedure, the cast would be applied to the leg or other appendage as normally done, with, perhaps, the final windings of the cast being used to hold the compressor unit 504 into place.

Figure 7A:
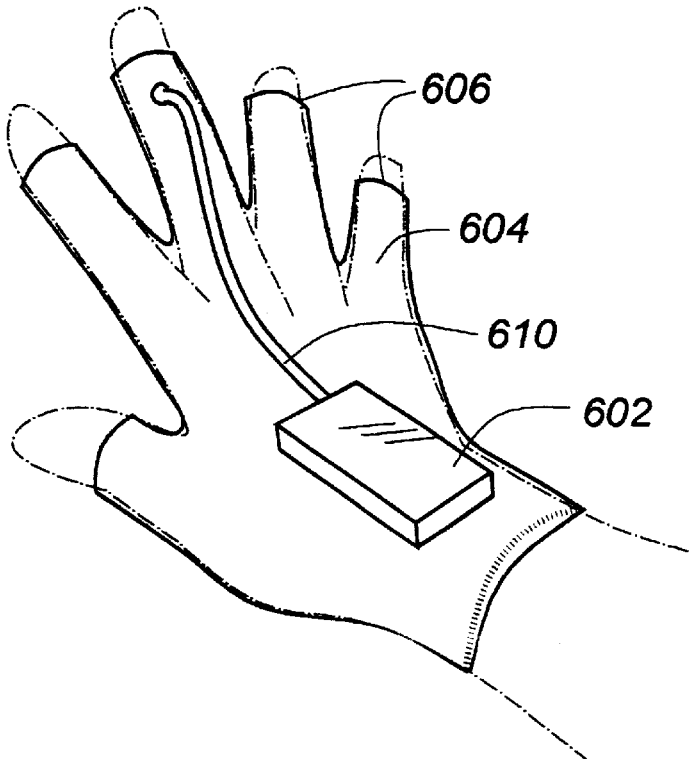
FIG. 7A is yet a further alternative embodiment of the invention wherein a portable inflatable/deflatable bladder is associated with a glove to treat conditions such as edema.
Figure 7B:
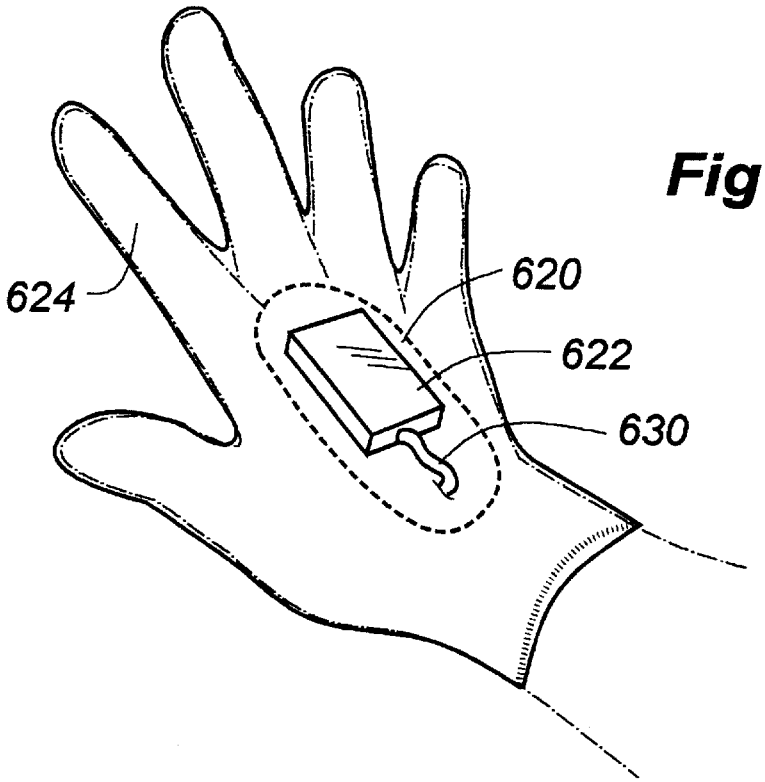
FIG. 7B is a drawing of a hand-applied embodiment of the invention wherein a larger bladder is placed on the back surface of the hand.
Figure 7C:
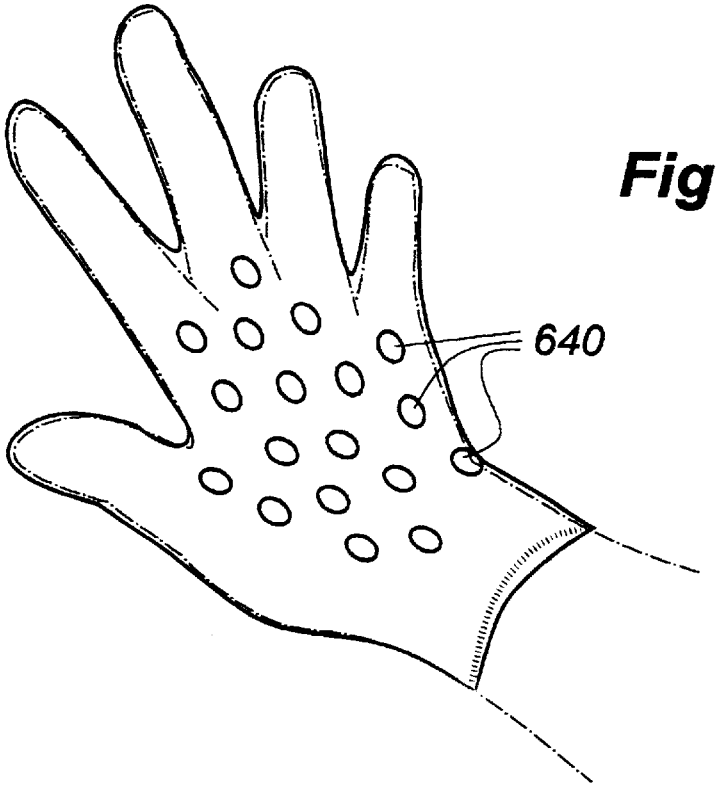
FIG. 7C illustrates how apertures may be provided to the glove or other embodiments of the invention, thereby permitting a breathable fabric while still being sufficiently inelastic to provide a requisite level of compression.

FIGS. 7A–7C illustrate ways in which the invention may be applied to the hand, in this case more to treat conditions such as edema, as opposed to DVT. In FIG. 7A, for example, a portable compressor unit 602 is mounted onto the top of a "glove-within-a-glove" structure 604 which may, or may not, have finger openings 606. Pneumatic tubing 610 from the portable compressor unit 602 extends to the outer glove through connections to one or more of the fingers, for example, with the inflation and deflation thereof being controlled in accordance with the condition to be treated or avoided.

FIG. 7B illustrates an alternative embodiment wherein a bladder 620 covers the entire back of the hand, thereby providing compression against a larger area. Again, however, the portable compressor unit 622 would be mounted or otherwise laminated to a glove structure 624 with tubing 630 interconnecting the unit to the bladder 620. As shown in FIG. 7C, perforations or larger apertures 640 may be provided in between the areas containing the bladder (s), thereby rendering a breathable nature to the fabric to avoid over-moistening of the skin, and rashes and other conditions which might result. So long as the remaining structure of the fabric used for the appliance is otherwise inelastic, holes or apertures 640 would not interfere with the low-power operation of the invention as described herein.

Thus, what has been described is a portable compression/decompression device which may be applied to various areas of the body to prevent conditions such as deep vein thrombosis, and to treat edema and like ailments. In contrast to existing devices, the invention is entirely self-contained, enabling all of the necessary components to be carried/worn by a user with the goal being higher compliance and greater effectiveness. Various embodiments of the invention are also more discrete as compared to existing devices, enabling the wearer to be treated, while in some cases, others do not even realize the inventive devices are in operation. For example, the leg-worn units may be slim enough in profile to be worn under trousers, and the shoe embodiment such as that depicted in FIG. 4 may be shaped and colored to look just like a piece of ordinary footwear. Even the glove embodiments associated with FIGS. 7A and 7C could be made very discrete, and in the form of a normal-looking glove.

We claim:

1. Portable apparatus for deep vein thrombosis (DVT) prophylaxis, comprising:

a substantially inelastic outer shell having an inner wall, the shell being dimensioned for wearing around a portion of a human limb having an outer surface;

an inflatable/deflatable bladder mounted adjacent the inner wall of the outer shell; and electrical and pneumatic circuitry, all wearable by the user without interconnection to any other apparatus, the electrical circuitry including:

an electrically operated air compressor, a source of electrical power in the form of batteries to power the compressor, an operator control to inflate the bladder and create positive pressure against the portion of the limb on a regular and periodic basis, and a sensor for operating the electrical circuitry only when the limb has been substantially motionless for a predetermined period of time.

2. The apparatus of claim 1, wherein the circuitry includes:

a pressure sensor in pneumatic communication with the bladder to terminate the operation of the compressor upon reaching a desired level of positive pressure.

3. The apparatus of claim 1, wherein the substantially inelastic outer shell is a cast worn by the user.

4. The apparatus of claim 1, wherein the circuitry further includes means for deflating the bladder upon achieving a predetermined pressure.

5. The apparatus of claim 4, wherein the means for deflating the bladder upon achieving a predetermined pressure includes a controlled leak valve or deflation valve.

6. The apparatus of claim 1, wherein the substantially inelastic outer shell is dimensioned for wearing around an upper portion of a human calf.

7. The apparatus of claim 1, wherein the substantially inelastic outer shell is dimensioned for wearing at least a portion of a human foot.

8. The apparatus of claim 1, wherein the substantially inelastic outer shell is dimensioned for wearing around at least a portion of a human hand.

9. The apparatus of claim 1, wherein the substantially inelastic outer shell is substantially rigid.

10. The apparatus of claim 1, wherein the substantially inelastic outer shell is composed of a non-stretch fabric.

11. Portable apparatus for deep vein thrombosis (DVT) prophylaxis, comprising:

a substantially inelastic outer shell having an inner wall, the shell being dimensioned for wearing around a portion of a human calf having an outer surface;

an inflatable/deflatable bladder mounted adjacent the inner wall of the outer shell; and battery-operated electrical and pneumatic circuitry, all wearable by the user without interconnection to any other apparatus, the electrical circuitry including:

an operator control to inflate the bladder and create positive pressure against the portion of the calf on a regular and periodic basis, a miniature compressor operative to expand the bladder, a pressure sensor operative to turn off the compressor upon reaching a desired level of bladder pressure, and a sensor for operating the electrical circuitry only when the limb has been substantially motionless for a predetermined period of time.

12. The apparatus of claim 11, wherein the inelastic outer shell forms part of a cast.

13. The apparatus of claim 11, wherein the circuitry further includes means for deflating the bladder upon achieving a predetermined pressure.

14. The apparatus of claim 13, wherein the means for deflating the bladder upon achieving a predetermined pressure includes a controlled leak valve or deflation valve.

15. The apparatus of claim 13, wherein the substantially inelastic outer shell is dimensioned for wearing around an upper portion of the human calf.

16. The apparatus of claim 13, wherein the substantially inelastic outer shell is dimensioned for wearing around a lower portion of the human calf, immediately above a human foot.

17. The apparatus of claim 11, wherein the substantially inelastic outer shell is substantially rigid.

18. The apparatus of claim 11, wherein the substantially inelastic outer shell is composed of a non-stretch fabric.

* * * * *